US009215769B2

(12) United States Patent
Ren et al.

(10) Patent No.: US 9,215,769 B2
(45) Date of Patent: Dec. 15, 2015

(54) LED BACKLIGHT DRIVER SYSTEM AND ASSOCIATED METHOD OF OPERATION

(75) Inventors: Frank Ren, Hangzhou (CN); Naixing Kuang, Hangzhou (CN); Bairen Liu, Hangzhou (CN); Licheng Sheng, Hangzhou (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 970 days.

(21) Appl. No.: 13/357,825

(22) Filed: Jan. 25, 2012

(65) Prior Publication Data

US 2012/0194078 A1 Aug. 2, 2012

(30) Foreign Application Priority Data

Jan. 30, 2011 (CN) ..... 2011 1 0035189

(51) Int. Cl.
*H05B 37/00* (2006.01)
*H05B 33/08* (2006.01)

(52) U.S. Cl.
CPC ..... *H05B 33/0818* (2013.01); *H05B 33/0887* (2013.01)

(58) Field of Classification Search
CPC ..... H05B 33/0809; H05B 33/0815; H05B 33/0818; H05B 33/0887
USPC ..... 315/122, 185 R, 193, 250, 254, 257, 315/276, 291, 294, 297, 299, 301, 307, 308, 315/312, 313
See application file for complete search history.

(56) References Cited

U.S. PATENT DOCUMENTS

| | | | | |
|---|---|---|---|---|
| 2009/0284164 | A1* | 11/2009 | Ray et al. | 315/218 |
| 2011/0101885 | A1 | 5/2011 | Yang | |
| 2011/0227493 | A1 | 9/2011 | Du | |
| 2011/0227497 | A1 | 9/2011 | Hu | |
| 2012/0153866 | A1* | 6/2012 | Liu | 315/294 |
| 2014/0160807 | A1* | 6/2014 | Han et al. | 363/21.02 |

* cited by examiner

*Primary Examiner* — William Hernandez
(74) *Attorney, Agent, or Firm* — Perkins Coie LLP

(57) ABSTRACT

The embodiments of the present circuit and method disclose a light-emitting diode (LED) driver system. The LED driver system may comprise an isolated converter and a DC/DC converter. The isolated converter may be coupled to a first input signal, and may provide a LED current and a bus voltage. The isolated converter may be configured to regulate the LED current and the bus voltage separately in accordance with a dimming signal. The DC/DC converter may comprise an input coupled to the bus voltage.

18 Claims, 12 Drawing Sheets

LED BACKLIGHT DRIVER SYSTEM AND ASSOCIATED METHOD OF OPERATION

CROSS-REFERENCE TO RELATED APPLICATION(S)

This application claims the benefit of CN application No. 201110035189.4, filed on Jan. 30, 2011, and incorporated herein by reference.

TECHNICAL FIELD

This invention relates generally to electrical circuits, and more particularly but not exclusively to light emitting diodes ("LEDs").

BACKGROUND

White LEDs ("WLEDs") have gained significant importance in the applications of general illumination market and display market. One example is the WLED street lamp application. Currently LED backlight power supplies typically use a three-stage driver system. Some other power supplies are also required for the LED backlight driver system, for example, 12V, and/or 5V.

There are several kinds of structures for LED backlight driver system, some examples are shown in FIG. 1A, FIG. 1B and FIG. 2. A power structure 100A for a three-stage LED backlight driver system with two isolated voltage converters is shown in FIG. 1A. Power structure 100A comprises a power factor correction ("PFC") stage, two isolated DC/DC (direct current to direct current) voltage converter stages, and a non-isolated LED driver stage. The PFC stage rectifies an AC (alternating current) voltage, e.g., 220V or 110V, to a DC (direct current) line voltage, e.g., 400V or 200V. One of the isolated DC/DC voltage converters is used to provide a DC power supply, e.g., 12V or 5V. And the other isolated DC/DC voltage converter is used to provide power for the LED driver stage. A power structure 100B for another three-stage LED backlight driver system with two isolated voltage converters is shown in FIG. 1B. Similar with power structure 100A, power structure 100B comprises a PFC stage, two isolated DC/DC voltage converter stages, and a non-isolated LED driver stage. One of the isolated DC/DC voltage converters is used to provide a DC power supply, such as 5V. And the other isolated DC/DC voltage converter is used to provide power for the LED driver stage and other DC power supply, such as 12V. FIG. 2 illustrates a power structure 200 for a three-stage LED backlight driver system with one isolated voltage converter. Power structure 200 comprises a PFC stage, an isolated DC/DC voltage converter stage, and non-isolated converters stage. The non-isolated converters comprise a LED driver and two non-isolated DC/DC converters. The isolated DC/DC voltage converter is used to provide power for the LED driver and the two non-isolated DC/DC converters.

The conventional LED backlight driver system comprises multiple converters such as isolated converters, non-isolated converters, and LED driver stage. The conventional LED backlight driver system is complex, has low efficiency and high costs.

SUMMARY

In one embodiment, a light-emitting diode (LED) driver system with a simple structure is disclosed. The LED driver system may comprise an isolated converter and a DC/DC converter. The isolated converter may be coupled to a first input signal, and may provide a LED current and a bus voltage. The isolated converter may be configured to regulate the LED current and the bus voltage separately in accordance with a dimming signal. The DC/DC converter may comprise an input coupled to the bus voltage.

The use of the same reference label in different drawings indicates the same or like components.

DETAILED DESCRIPTION

In the present disclosure, numerous specific details are provided, such as examples of circuits, components, and methods, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

Several embodiments of the present invention are described below with reference to LED backlight driver system and associated method of operation. As used hereinafter, the term "LED" encompasses LEDs, laser diodes ("LDs"), polymer LEDs ("PLEDs"), and/or other suitable light emitting diodes. The term "LED string" means one LED or more LEDs coupled in series. The term "couple" generally refers to multiple ways including a direct connection with an electrical conductor and an indirect connection through intermediate diodes, resistors, capacitors, and/or other intermediaries. The term "isolated" general refers to the fact that the input and the output of the converter are isolated by an electrical barrier, typically a transformer.

Figure 1A:
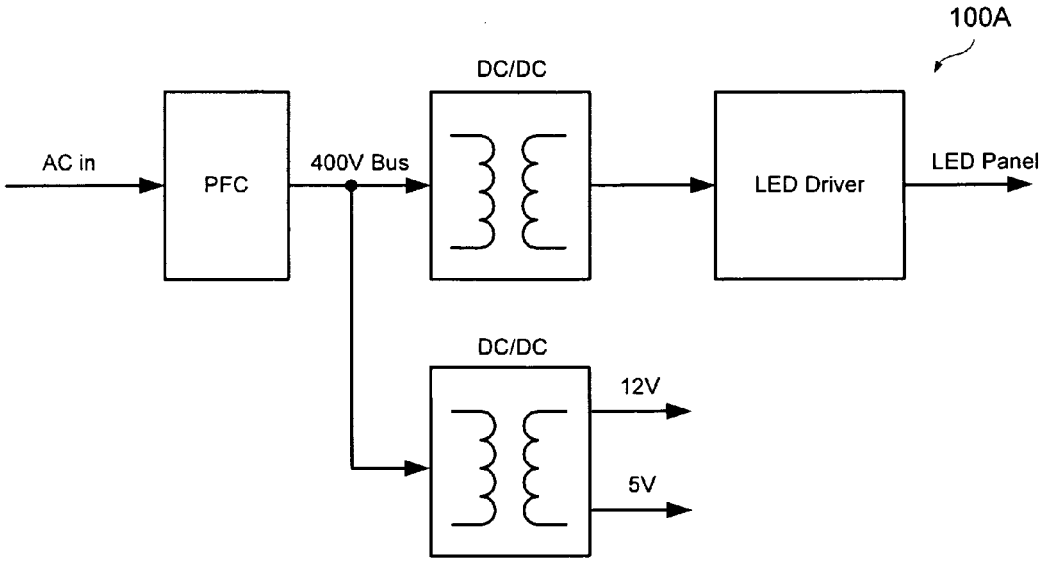
FIG. 1A (Prior Art)
FIG. 1A illustrates a prior art power structure for a three-stage LED backlight driver system with two isolated voltage converters.
Figure 1B:
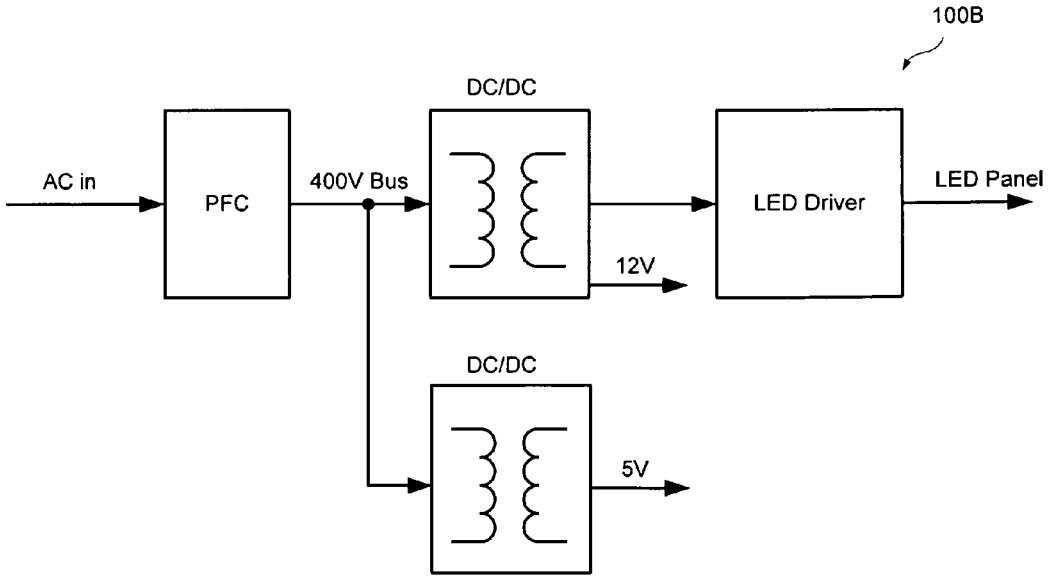
FIG. 1B (Prior Art)
FIG. 1B illustrates another prior art power structure for a three-stage LED backlight driver system with two isolated voltage converters.
Figure 2:
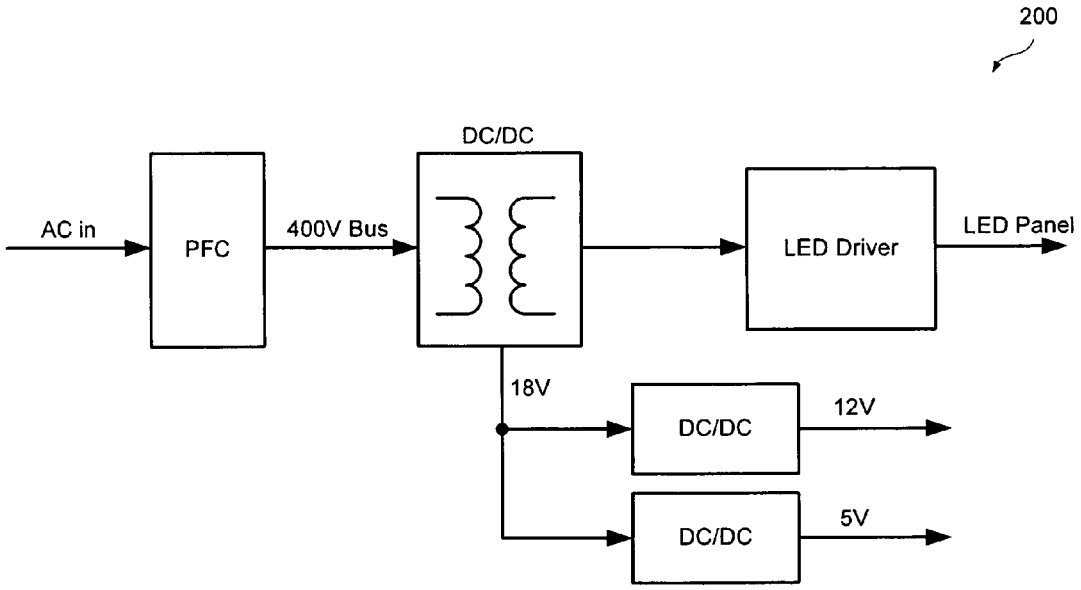
FIG. 2 (Prior Art)
FIG. 2 illustrates a prior art power structure for a three-stage LED backlight driver system with one isolated voltage converter.
Figure 3:
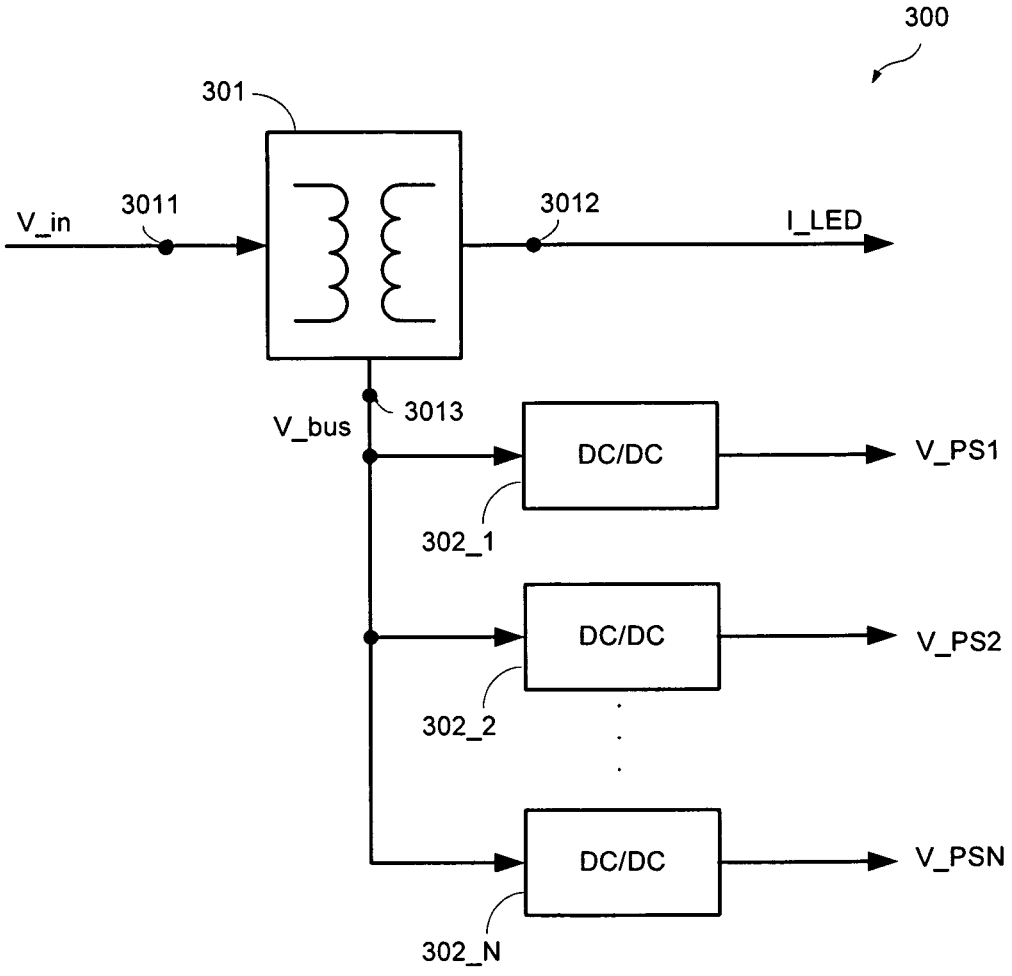
FIG. 3 illustrates a block diagram of a LED backlight driver system in accordance with an embodiment of the present invention.

FIG. 3 illustrates a block diagram of a LED backlight driver system 300 in accordance with an embodiment of the present invention. LED backlight driver system 300 comprises an isolated converter 301 and at least a DC/DC converter. Persons of ordinary skill in the art will recognize, however, LED backlight driver system 300 may comprise more than one DC/DC converter. As shown in FIG. 3, LED backlight driver system 300 comprises DC/DC converters 302_1 to 302_N, wherein N is an integer, and N≥1.

Isolated converter 301 has an input 3011, an output 3012 and an output 3013. Input 3011 is configured to receive an input signal V_in. Isolated converter 301 is configured to provide power for a LED string (not shown in FIG. 3) and DC/DC converters 302_1 to 302_N. Output 3012 is configured to provide a LED current I_LED and output 3013 is configured to provide a bus voltage V_bus. LED current I_LED indicates value of a current flowing from an anode to a cathode of the LED string. Bus voltage V_bus is employed to provide power for DC/DC converter 302_1 to 302_N. In one embodiment, input signal V_in is received from a power factor correction (PFC) circuit. One of ordinary skill in the art will appreciate that other circuits may also be used to provide input signal V_in without detracting from the merits of the present invention. Isolated converter 301 may be any current type topology, e.g., LLC resonant converter, fly-back converter, etc. The method for controlling isolated converter 301 may apply PWM (Pulse Width Modulation), or PFM (Pulse Frequency Modulation), etc. The feedback mode of the control method may apply peak current control, average current control, or hysteresis current control.

Each DC/DC converter 302_1 to 302_N has an input coupled to bus voltage V_bus and provides an output voltage, i.e., V_PS1 to V_PSN. For example, DC/DC converter 302_1 provides output voltage V_PS1, DC/DC converter 302_2 provides output voltage V_PS2, and DC/DC converter 302_N provides output voltage V_PSN. DC/DC converter 302_1 to 302_N may be any type of DC/DC converter circuit, e.g. boost converter circuit, buck converter circuit, etc.

A dimming signal DIM is employed, and pulse width modulation ("PWM") dimming method may be used to adjust the luminance of the LED string. While power is supplied to the LED string and LED current I_LED is positive when dimming signal DIM is activated (e.g., dimming signal DIM is logic HIGH); and the power supplied to the LED string is cut off and LED current I_LED is almost zero ampere when dimming signal DIM is deactivated (e.g., dimming signal DIM is logic LOW). Isolated converter 301 is configured to regulate LED current I_LED and bus voltage V_bus separately in accordance with dimming signal DIM. In one embodiment, LED current I_LED is regulated when dimming signal DIM is activated, and bus voltage V_bus is regulated when dimming signal DIM is deactivated.

As described in the foregoing, LED driver system 300 is preferred for cost and simple architecture to achieve regulation of both LED current I_LED and bus voltage V_bus.

Figure 4:
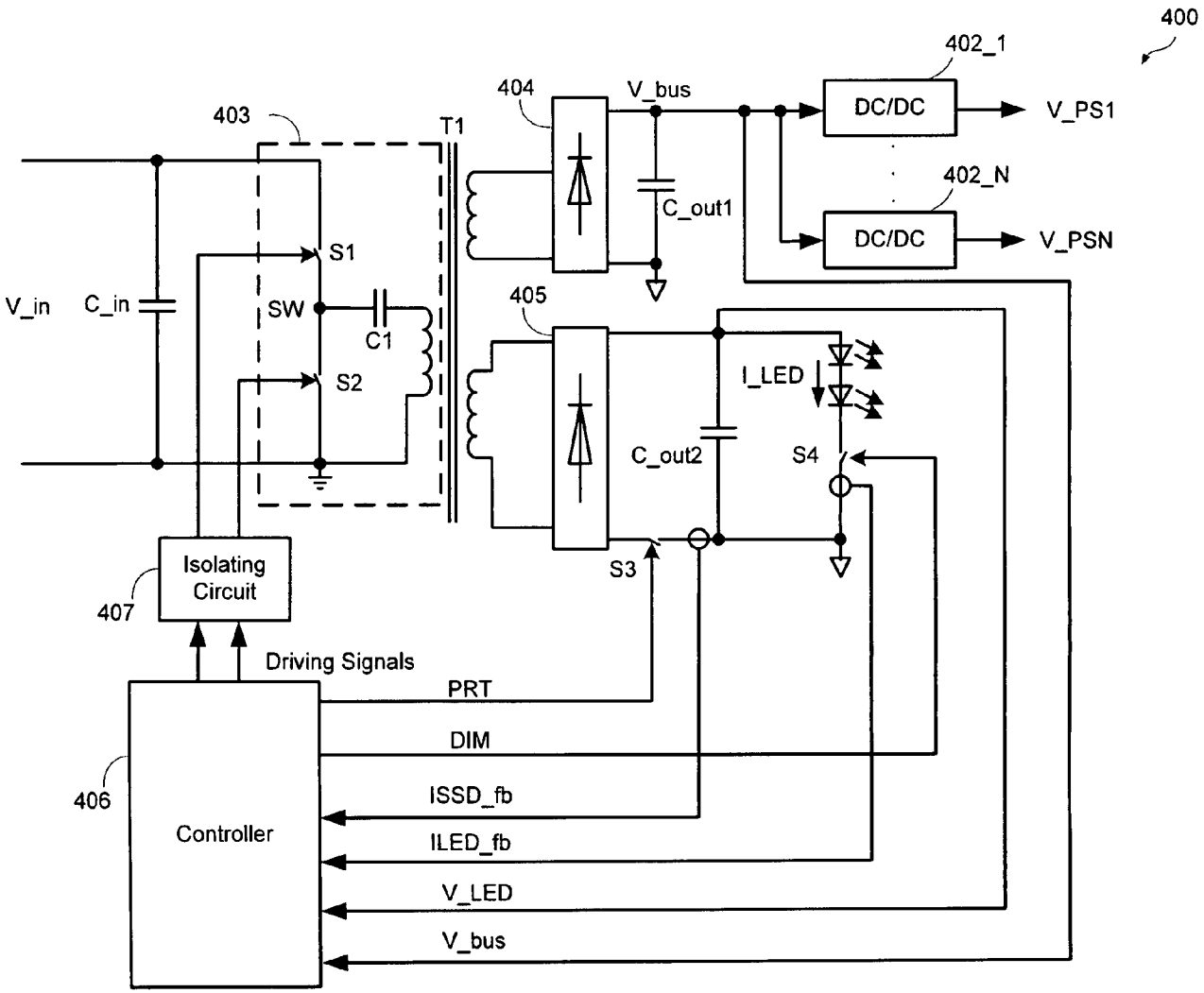
FIG. 4 schematically illustrates a LED backlight driver system in accordance with an embodiment of the present invention.

FIG. 4 schematically illustrates a LED backlight driver system 400 in accordance with an embodiment of the present invention. LED backlight driver system 400 comprises an isolated converter and DC/DC converter 402_1 to 402_N. The isolated converter comprises a primary circuit 403, an isolated transformer T1, a first rectified circuit 404, a second rectified circuit 405, and a controller 406. The isolated converter may further comprises an input capacitor C_in connected to input of primary circuit 403, a first output capacitor C_out1 coupled to output of first rectified circuit 404, and a second output capacitor C_out2 coupled to output of second rectified circuit 405.

Primary circuit 403 comprises at least a primary side switch, wherein primary circuit 403 is configured to receive an input signal V_in, and wherein the primary side switch is switched to provide an AC signal. Isolated transformer T1 comprises a primary winding coupled to the primary side switch and two secondary windings, wherein the primary winding is coupled to the AC signal provided by the primary side switch. First rectified circuit 404 at a secondary side of the isolated converter is coupled to a first secondary winding of transformer T1 and first rectified circuit 404 is configured to provide a DC bus voltage V_bus, for example, 18V. Second rectified circuit 405 at a secondary side of the isolated converter is coupled to a second secondary winding of transformer T1 and second rectified circuit 405 is configured to provide a LED current I_LED. Controller 406 is configured to receive a feedback voltage signal V_bus from first rectified circuit 404 and a feedback current signal ILED_fb from second rectified circuit 405, and controller 406 is configured to provide a control signal CTRL coupled to a control terminal of the primary side switch. Control signal CTRL is configured to be responsive to the feedback voltage signal from first rectified circuit 404 and the feedback current signal from second rectified circuit 405. In one embodiment, controller 406 is further configured to receive an output voltage V_LED of second rectified circuit 405 and controller 406 is further configured to receive a feedback output current ISSD_fb of second rectified circuit 405. In one embodiment, controller 406 is further configured to provide a dimming signal DIM coupled to second rectified circuit 405 and a protection signal PRT coupled to second rectified circuit 405. In one embodiment, controller 406 is located at the primary side of the isolated converter. In another embodiment, controller 406 is located at the secondary side of the isolated converter.

In one embodiment, primary circuit 403 comprises a primary switches S1 and S2, and a capacitor C1. Primary circuit 403 regulates input signal V_in to an AC signal through switch S1 and switch S2 and the AC signal is coupled to the primary winding of transformer T1. One of ordinary skill in the art will appreciate that other topologies of primary circuit 403, e.g., half-bridge circuit may also be used without detracting from the merits of present invention. First rectified circuit 404/second rectified circuit 405 may be a half-wave rectifier circuit or a full-wave rectifier circuit. DC/DC converters 402_1 to 402_N convert bus voltage V_bus to DC voltage V_PS1 to V_PSN correspondingly. For example, DC/DC converter 402_1 converts bus voltage V_bus to DC voltage V_PS1, DC/DC converter 402_2 converts bus voltage V_bus to DC voltage V_PS2 and DC/DC converter 402_N converts bus voltage V_bus to DC voltage V_PSN.

One of ordinary skill in the art will appreciate that switch S1 and switch S2 may be metal oxide semiconductor field effect transistor ("MOSFET"). The MOSFET can be either N type or P type. Other types of switches such as bipolar junction transistor ("BJT") or junction field effect transistor ("JFET") can also be adopted.

The isolated converter may further comprise a protection switch S3. Protection switch S3 is coupled between second rectified circuit 405 and a LED string. Protection switch S3 is configured to be turned OFF to stop a power supplied to the LED string when fault condition occurs at second rectified circuit 405. Protection signal PRT is set activated when fault condition occurs at second rectified circuit 405. Protection signal PRT is coupled to a control terminal of protection switch S3. Fault condition at second rectified circuit 405 may comprise over voltage condition or over current condition at output of rectified circuit 405, and over current condition at the LED string. In one embodiment, controller 406 is configured to receive some feedback signals. As shown in FIG. 4, bus voltage V_bus of first rectified circuit 404, feedback output current ISSD_fb of second rectified circuit 405, feedback LED current ILED_fb, and output voltage V_LED of second rectified circuit 405 are feedback to controller 406. In one embodiment, protection switch S3 is turned ON to provide the power supply for the LED string when dimming signal DIM is activated; and protection switch S3 is turned OFF to stop the power supply for the LED string when dimming signal DIM is deactivated.

The isolated converter may further comprise a dimming switch S4 coupled to the LED string in series. Dimming switch S4 has a control terminal. The control terminal of dimming switch S4 is configured to receive dimming signal DIM. Dimming switch S4 is configured to be turned ON to provide the power supply for the LED string when dimming signal DIM is activated, and dimming switch S4 is configured to be turned OFF to stop the power supply for the LED string when dimming signal DIM is deactivated.

Continuing with FIG. 4, controller 406 is placed at the secondary side of transformer T1, an isolating circuit 407 is coupled between controller 406 and primary circuit 403, i.e., controller 406 is coupled to primary circuit 503 through isolating circuit 407. Isolating circuit 407 comprises transformer or photo-coupler.

In one embodiment, protection switch S3 or dimming switch S4 is a metal oxide semiconductor field effect transistor ("MOSFET"). The MOSFET can be either N type or P type. Other types of switches such as bipolar junction transistor ("BJT") or junction field effect transistor ("JFET") can also be adopted as protection switch S3 or dimming switch S4.

Figure 5:
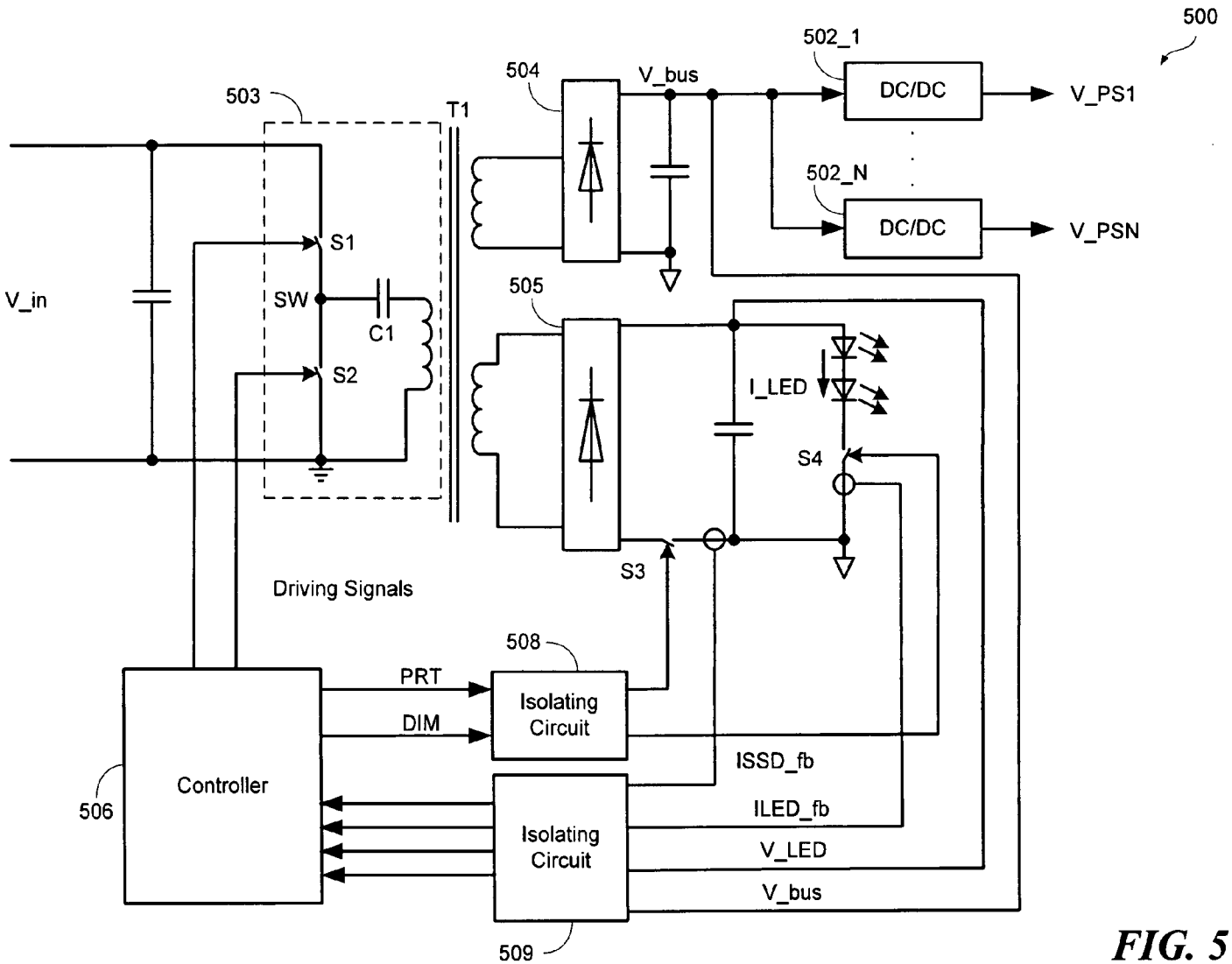
FIG. 5 schematically illustrates a LED backlight driver system in accordance with another embodiment of the present invention.

FIG. 5 schematically illustrates a LED backlight driver system 500 in accordance with another embodiment of the present invention. LED driver system 500 is similar with LED driver system 400, differences between them are described for simplicity and clarity. A controller 506 is placed at a primary side of a transformer T1. An isolating circuit 508 and an isolating circuit 509 are coupled between controller 506 and a secondary side of transformer T1. Isolating circuit 508 is coupled between controller 506 and a second rectified circuit 505. In one embodiment, isolating circuit 508 is employed to receive a dimming signal DIM and a protection signal PRT and is configured to provide driving signals for a protection switch S3 and a dimming switch S4. In one embodiment, isolating circuit 509 is configured to receive a feedback output current ISSD_fb of second rectified circuit 505, a feedback current signal ILED_fb, an output voltage V_LED of second rectified circuit 505, and a bus voltage V_bus of a first rectified circuit 504, and isolating circuit 509 is configured to provide corresponding signals to controller 506.

Figure 6:
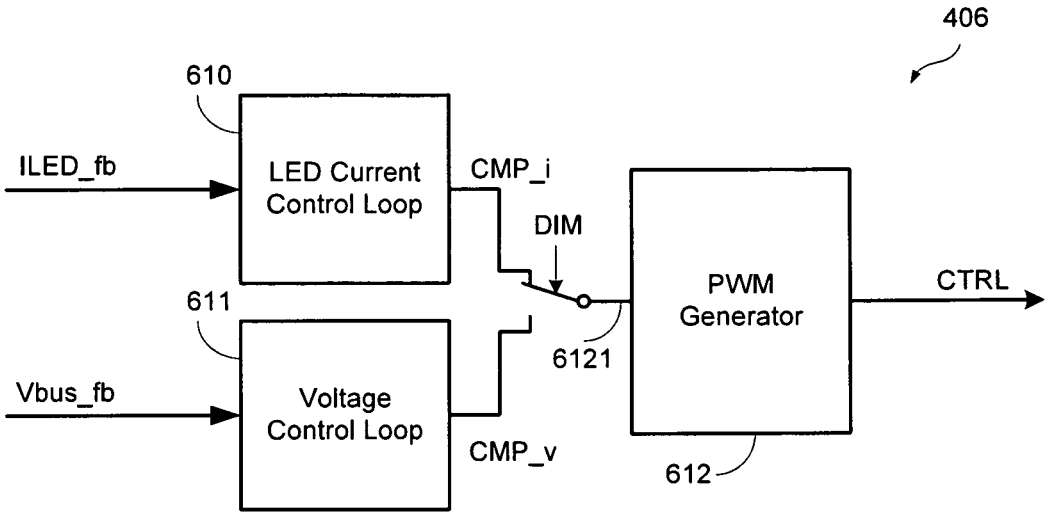
FIG. 6 schematically illustrates a block diagram of controller 406 shown in FIG. 4 in accordance with an embodiment of the present invention.

FIG. 6 schematically illustrates a block diagram of controller 406 shown in FIG. 4 in accordance with an embodiment of the present invention. Controller 406 comprises a current regulating loop 610, a voltage regulating loop 611 and a PWM generator 612. Current regulating loop 610 is configured to provide a current compensation signal CMP_i responsive to a feedback current signal ILED_fb indicating a value of LED current I_LED. Voltage regulating loop 611 is configured to provide a voltage compensation signal CMP_v responsive to a feedback voltage signal Vbus_fb indicating a value of bus voltage V_bus. PWM generator 612 comprises an input 6121 and an output configured to provide a pulse width modulation (PWM) control signal CTRL. Input 6121 of PWM generator 612 is coupled to current compensation signal CMP_i when dimming signal DIM is activated (e.g., DIM=1), and input 6121 of PWM generator 612 is coupled to voltage compensation signal CMP_v when dimming signal DIM is deactivated (e.g., DIM=0). As a result, LED current I_LED is regulated when dimming signal DIM is activated and bus voltage V_bus is regulated when dimming signal DIM is deactivated. Control signal CTRL is configured to be responsive to current compensation signal CMP_i when dimming signal DIM is activated, and is configured to be responsive to voltage compensation signal CMP_v when dimming signal DIM is deactivated.

In one embodiment, controller 406 comprises a switch 613 coupled between current regulating loop 610, voltage regulating loop 611 and PWM generator 612. Switch 613 comprises a control terminal couple to dimming signal DIM, a controllable first terminal coupled to current regulating loop 610 or voltage regulating loop 611, and a second terminal coupled to PWM generator. The controllable first terminal of switch 613 is configured to receive the current compensation signal CMP_i when dimming signal DIM is activated, and the controllable first terminal of switch 613 is configured to receive the voltage compensation signal CMP_v when dimming signal DIM is deactivated. A voltage at the second terminal of switch 613 is configured to generate the control signal through PWM generator 612.

In one embodiment, PWM generator 612 is configured to provide control signal CTRL responsive to voltage compensation signal CMP_v when fault condition occurs at second rectified circuit 405.

Figure 7:
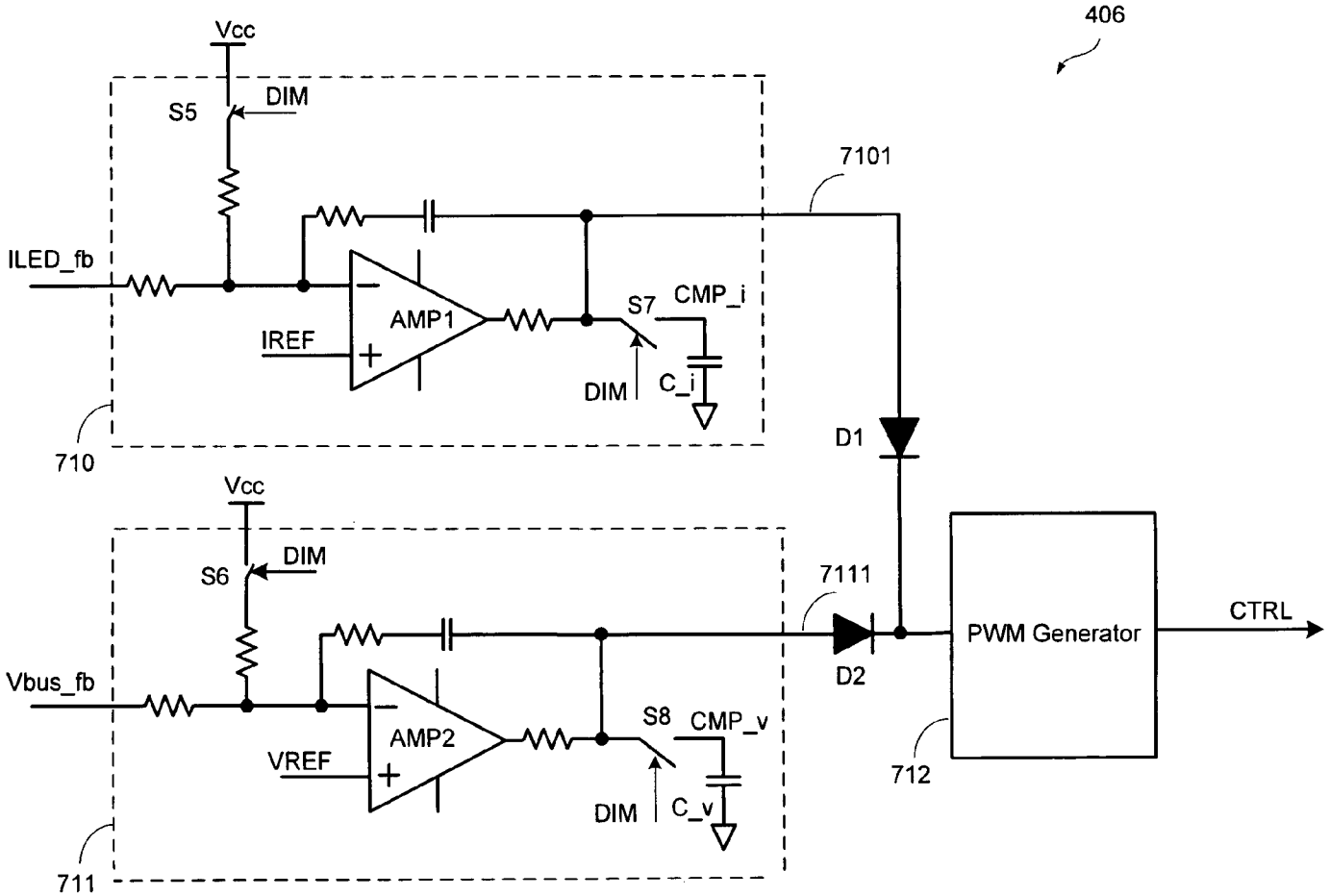
FIG. 7 schematically illustrates a detailed circuit of controller 406 shown in FIG. 4 in accordance with an embodiment of the present invention.

FIG. 7 schematically illustrates a detailed circuit of controller 406 shown in FIG. 4 in accordance with an embodiment of the present invention. Controller 406 comprises a current regulating loop 710, a voltage regulating loop 711 and a PWM generator circuit 712. Current regulating loop 710 is configured to provide a current compensation signal CMP_i by comparing a feedback current signal ILED_fb with a current reference IREF. Voltage regulating loop 711 is configured to provide a voltage compensation signal CMP_v by comparing a feedback voltage signal Vbus_fb with a voltage reference VREF. PWM generator 712 is coupled to current regulating loop 710 and voltage regulating loop 711. PWM generator 712 is configured to provide a control signal CTRL. Control signal CTRL is configured to be responsive to current compensation signal CMP_i when dimming signal DIM is activated, control signal CTRL is configured to be responsive to voltage compensation signal CMP_v when dimming signal DIM is deactivated, and control signal CTRL is coupled to a control terminal of a switch S1 and/or a control terminal of a switch S2 shown in FIG. 4.

In one embodiment, LED current I_LED is configured to be regulated to current reference IREF when dimming signal DIM is activated, and bus voltage V_bus is configured to be regulated to voltage reference VREF when dimming signal DIM is deactivated.

Current regulating loop 710 comprises an amplifier AMP1, a switch S5, a switch S7 and a capacitor C_i. Amplifier AMP1 comprises an inverting terminal, a non-inverting terminal and an output terminal as an output 7101 of current regulating loop 710. Capacitor C_i is employed to provide current compensation signal CMP_i. A compensation network may be employed to improve performance of current regulating loop 710. When dimming signal DIM is activated, switch S5 is configured to be turned OFF and switch S7 is configured to be turned ON. Feedback current signal ILED_fb is coupled to the inverting terminal of amplifier AMP1, current reference IREF is coupled to the non-inverting terminal of amplifier AMP1. Then amplifier AMP1 provides current compensation signal CMP_i by comparing feedback current signal ILED_fb with current reference IREF. When dimming signal DIM is deactivated, switch S5 is configured to be turned ON and switch S7 is configured to be turned OFF. The inverting terminal of amplifier AMP1 is pulled up to an external voltage VCC which may be higher than current reference IREF. As a result, output of amplifier AMP1 is LOW, i.e., about 0V. Current compensation signal CMP_i comprises a voltage across capacitor C_i, and is configured to keep its value when dimming signal DIM is deactivated.

Voltage regulating loop 711 comprises an amplifier AMP2, a switch S6, a switch S8 and a capacitor C_v. Amplifier AMP2 comprises an inverting terminal, a non-inverting terminal and an output terminal as an output 7111 of voltage regulating loop 711. Capacitor C_v is employed to provide voltage compensation signal CMP_v. A compensation network may be employed to improve performance of voltage regulating loop 711. When dimming signal DIM is activated, switch S6 is configured to be turned ON and switch S8 is configured to be turned OFF. Voltage reference VREF is coupled to the non-inverting terminal of amplifier AMP2. The inverting terminal of amplifier AMP2 is pulled up to an external voltage VCC which may be higher than voltage reference VREF. As a result, output of amplifier AMP2 is LOW, i.e., about 0V. Voltage compensation signal CMP_v comprises a voltage across capacitor C_v, and is configured to keep its value when dimming signal DIM is activated. When dimming signal DIM is deactivated, switch S6 is configured to be turned OFF and switch S8 is configured to be turned ON. Feedback voltage signal Vbus_fb is coupled to the inverting terminal of amplifier AMP2, voltage reference VREF is coupled to the non-inverting terminal of amplifier AMP2. Then amplifier AMP2 provides voltage compensation signal CMP_v by comparing feedback voltage signal Vbus_fb with voltage reference VREF.

PWM generator 712 is coupled to output 7101 of current regulating loop 710 and output 7111 of voltage regulating loop 711. When dimming signal DIM is activated, output 7101 of current regulating loop 710 equals current compensation signal CMP_i, output 7111 of voltage regulating loop 711 is about 0V. Output 7101 of current regulating loop 710 is higher than output 7111 of voltage regulating loop 711 and PWM generator 712 is configured to receive output 7101 of current regulating loop 710. When dimming signal DIM is deactivated, output 7101 of current regulating loop 710 is about 0V, output 7111 of voltage regulating loop 711 equals voltage compensation signal CMP_v. Output 7111 of voltage regulating loop 711 is higher than output 7101 of current regulating loop 710 and PWM generator 712 is configured to receive output 7111 of voltage regulating loop 711. In one embodiment, output 7101 of current regulating loop 710 is coupled to PWM generator 712 through a diode D1. an anode of diode D1 is coupled to output 7101 of current regulating loop 710 and a cathode of diode D1 is coupled to PWM generator 712. In one embodiment, output 7111 of voltage regulating loop 711 is coupled to PWM generator 712 through a diode D2. An anode of diode D2 is coupled to output 7111 of voltage regulating loop 711 and a cathode of diode D2 is coupled to PWM generator 712.

In one embodiment, when dimming signal DIM is activated, switch S8 is turned OFF and voltage compensation signal CMP_v is maintained by capacitor C_v. When dimming signal DIM is deactivated, switch S7 is turned OFF and current compensation signal CMP_i is maintained by capacitor C_i. As a result, transient performance provided by PWM generator 712 is improved.

In one embodiment, voltage reference VREF is set a little lower than bus voltage V_bus at activated dimming signal DIM interval. As a result, output voltage V_LED of second rectified circuit 405 will not increase suddenly at activated dimming signal DIM interval, and therefore LED current I_LED will not be overshot at deactivated dimming signal interval.

In another embodiment, voltage reference VREF is set same as the value of bus voltage V_bus at activated dimming signal DIM interval, and then voltage reference VREF keeps its value at deactivated dimming signal DIM interval. As a result, bus voltage V_bus follows output voltage V_LED of second rectified circuit 405 and keeps its value at deactivated dimming signal DIM interval. Therefore LED current I_LED will not be overshot at activated dimming signal DIM interval and bus voltage V_bus will maintain its value from activated to deactivated dimming interval.

Figure 8:
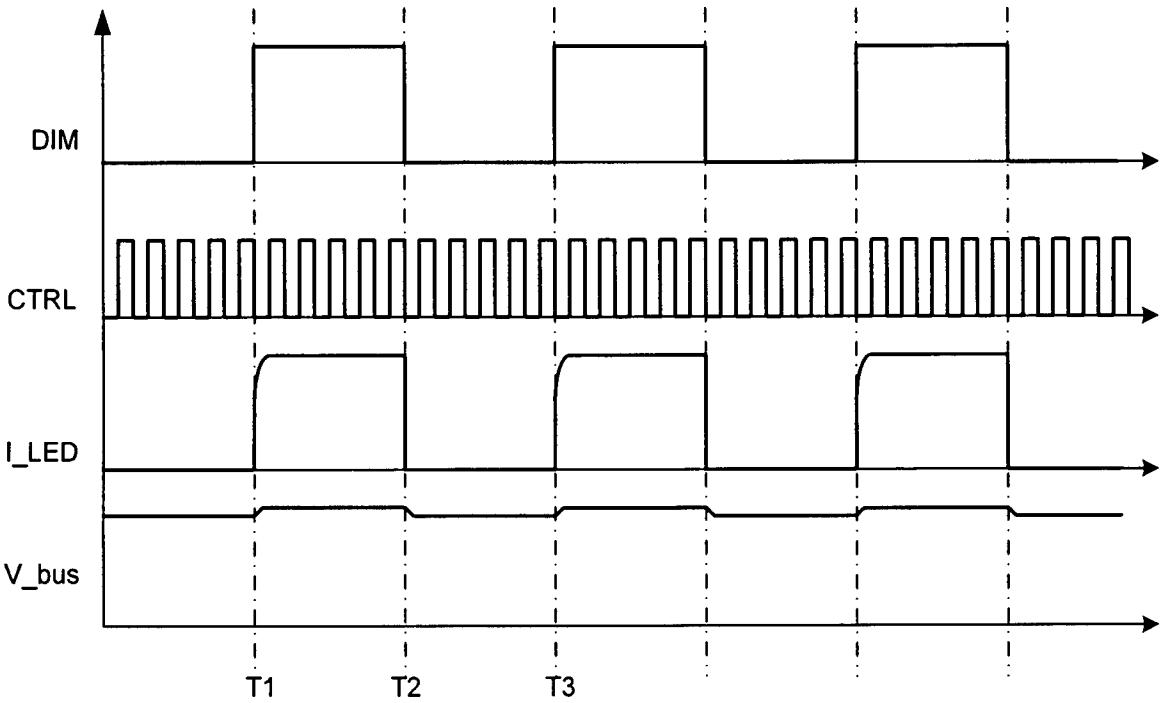
FIG. 8 shows waveforms of the circuit of FIG. 7 in accordance with an embodiment of the present invention.

FIG. 8 shows example waveforms of the circuit of FIG. 7 in accordance with an embodiment of the present invention. A first waveform shows a dimming signal DIM, High logic diming signal DIM indicates activated diming interval and LOW logic diming signal DIM indicates deactivated dimming interval. A second waveform shows a control signal CTRL. A third waveform shows a LED current I_LED and a fourth waveform shows a bus voltage V_bus.

Before time T1, dimming signal DIM is logic LOW, i.e., deactivated, and LED current I_LED equals zero ampere. PWM generator 712 is configured to receive voltage compensation signal CMP_v, and bus voltage V_bus is regulated to a voltage reference VREF. Control signal CTRL is provided by PWM generator 712 in accordance with a feedback voltage signal indicating bus voltage V_bus.

In the time period T1-T2, dimming signal DIM becomes logic HIGH, i.e., activated, PWM generator 712 is configured to receive current compensation signal CMP_i, and LED current I_LED is regulated to a current reference IREF. Control signal CTRL is provided by PWM generator 712 in accordance with a feedback current signal indicating LED current I_LED.

In the time period T2-T3, dimming signal DIM becomes logic LOW, and LED current I_LED equals zero ampere. Bus voltage V_bus is fed back to PWM generator 712 and is regulated to voltage reference VREF. Control signal CTRL is provided by PWM generator 712 in accordance with the feedback voltage signal indicating bus voltage V_bus. In one embodiment, bus voltage V_bus is a little lower than at activated diming interval, then LED driver voltage will not increase, and therefore LED current I_LED will not be overshot.

In one embodiment, a driving circuit is employed to provide driving signals for primary side switches. The driving circuit is coupled between a control signal CTRL and the primary side switches. The driving circuit may be responsive to a fault signal indicating fault condition occurs at a first rectified circuit and disable the driving signals.

Figure 9:
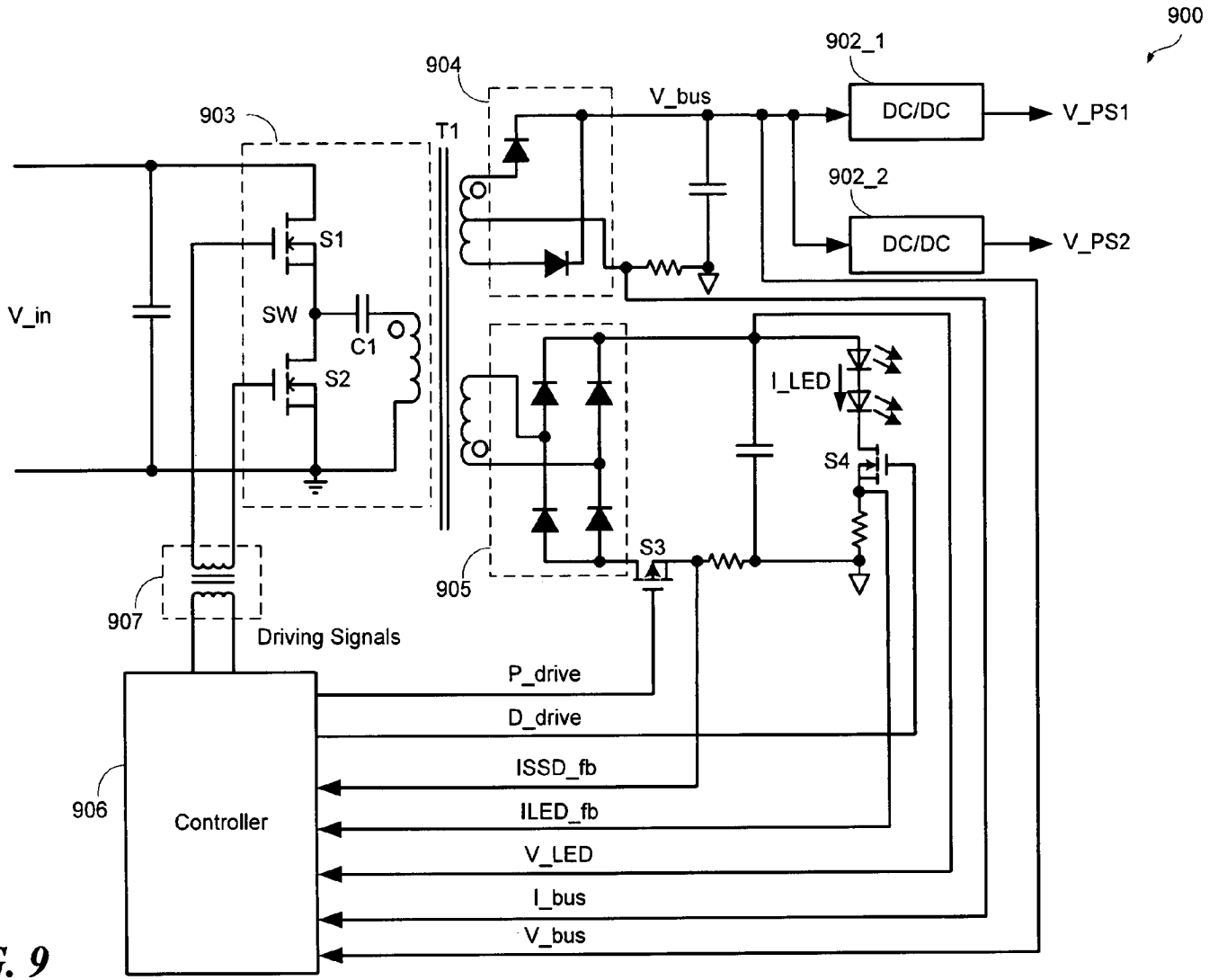
FIG. 9 schematically illustrates a further detailed LED backlight driver system 900 in accordance with an embodiment of the present invention.

FIG. 9 schematically illustrates a further detailed LED backlight driver system 900 in accordance with an embodiment of the present invention. The structure of circuit 900 is same as circuit 400 except detailed described components and circuits. Only differences are described below for clarity. LED backlight driver system 900 comprises an isolated converter and DC/DC converters 902_1 to 902_N. The isolated converter comprises a primary circuit 903, an isolated transformer T1, a first rectified circuit 904, a second rectified circuit 905, a controller 906 and an isolating circuit 907.

Primary side circuit 903 comprises primary side switch S1, primary side switch S2 and a capacitor C1. In one embodiment, primary side switch S1 comprises an N type MOSFET, and primary side switch S2 comprises an N type MOSFET. First rectified circuit 904 comprises a full-wave rectified circuit and second rectified circuit 905 comprises a full-bridge rectified circuit. A protecting switch S3 comprises a P type MOSFET and a dimming switch S4 comprises an N type MOSFET. Controller 906 is configured to receive a bus voltage V_bus from first rectified circuit 904, a feedback output current Ibus_fb from first rectified circuit 904, a feedback output current ISSD_fb from second rectified circuit 905, a feedback LED current ILED_fb, and an output voltage V_LED from second rectified circuit 905. Controller 906 is configured to provide driving signals for switch S1 and switch S2. Controller 906 may further provide a driving signal P_drive for protection switch S3 and a driving signal D_drive for dimming switch S4. Isolating circuit 907 is coupled between controller 906 and primary circuit 903. In one embodiment, Isolating circuit 907 comprises a transformer. Isolating circuit 907 may comprise a photo-coupler.

Continuing with FIG. 9, when fault condition occurs at second rectified circuit 905, controller 906 provides deactivated driving signal P_drive, protection switch S3 is configured to be turned OFF and a LED string is disconnected from second rectified circuit 905. In one embodiment, the isolated converter is configured in normal operation when fault condition occurs at second rectified circuit 905. When fault condition occurs at first rectified circuit 904, controller 906 disables driving signals for switch S1 and switch S2, switch S1 and switch S2 are configured to be turned OFF.

Figure 10:
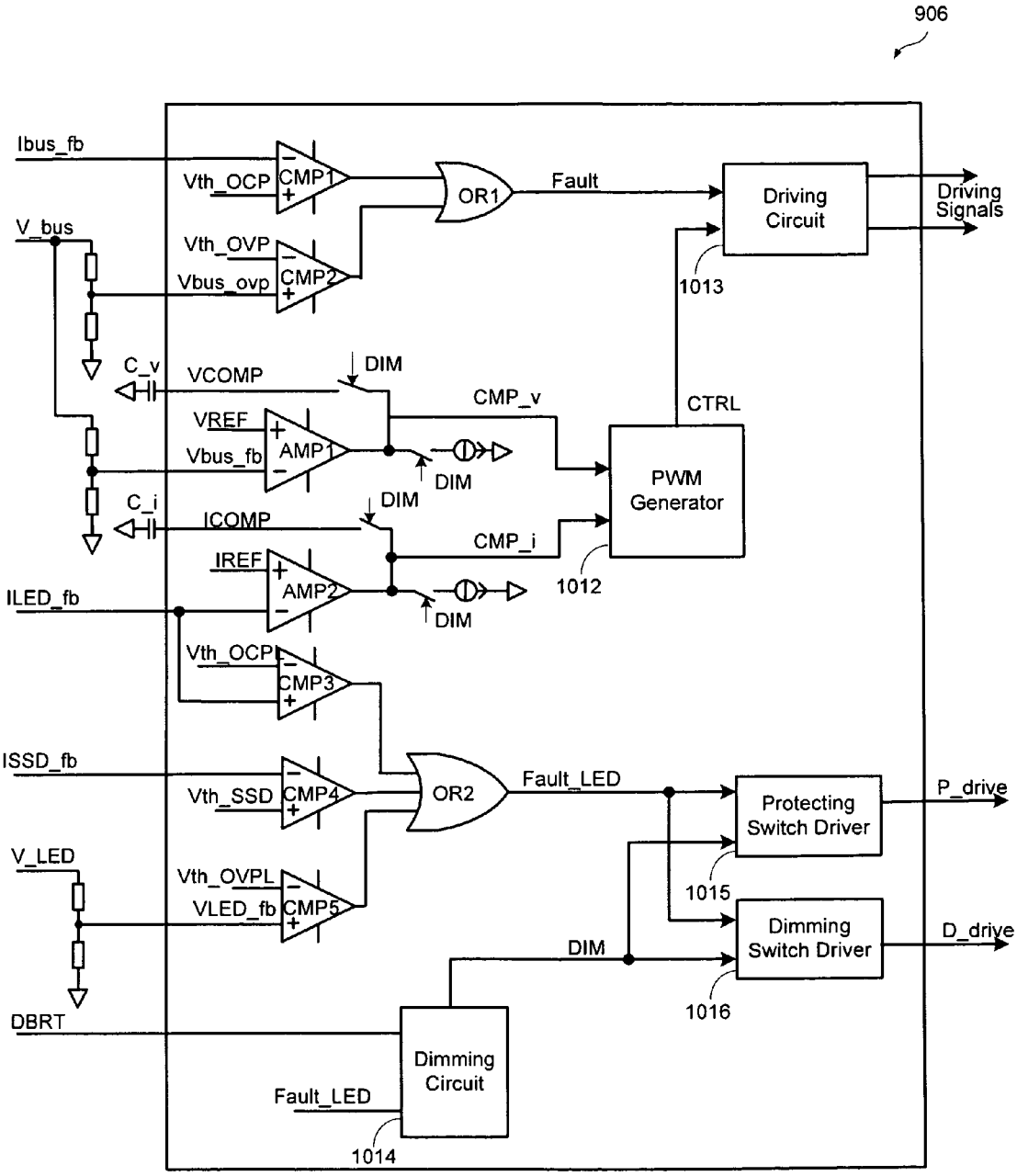
FIG. 10 schematically illustrates a detailed circuit of controller 906 shown in FIG. 9 in accordance with an embodiment of the present invention.

FIG. 10 schematically illustrates a detailed circuit of controller 906 shown in FIG. 9 in accordance with an embodiment of the present invention.

Continuing with FIG. 9 and FIG. 10, controller 906 comprises a PWM generator 1012, a driving circuit 1013, a dimming circuit 1014, a protecting switch driver 1015, a dimming switch driver 1016, plurality comparators, and plurality amplifiers. Controller 906 is configured to provide driving signals for switch S1 and switch S2. Controller 906 may further provide a driving signal P_drive for protecting switch S3 and a driving signal D_drive for dimming switch S4. Controller 906 comprises plurality input signals from first rectified circuit 904 and second rectified circuit 905. For example, signals from first rectified circuit 904 comprises a bus voltage v_bus and a feedback output current Ibus_fb. Signals from second rectified circuit 905 comprises an output voltage V_LED, a feedback output current ISSD_fb and a feedback LED current ILED_fb.

Same as circuit 700 shown in FIG. 7, PWM generator 1012 is configured to provide a control signal CTRL responsive to a voltage regulating loop and a current regulating loop. Voltage regulating loop comprises an amplifier AMP1. In one embodiment, bus voltage V_bus is divided by a resistor divider, and a feedback bus voltage Vbus_fb is provided accordingly. Amplifier AMP1 comprises an inverting terminal coupled to feedback bus voltage Vbus_fb, a non-inverting terminal coupled to a voltage reference VREF, and an output terminal coupled to PWM generator 1012. Current regulating loop comprises an amplifier AMP2. Amplifier AMP2 comprises an inverting terminal, a non-inverting terminal and an output. The inverting terminal is coupled to a feedback LED current ILED_fb. The non-inverting terminal is coupled to a current reference IREF. And the output terminal is coupled to PWM generator 1012.

When dimming signal DIM is activated, a current compensation signal CMP_i is provided to PWM generator 1012 by amplifier AMP2 and a capacitor C_v is employed to maintain a voltage compensation signal CMP_v. When dimming signal DIM is deactivated, voltage compensation signal CMP_v is provided to PWM generator 1012 by amplifier AMP1 and a capacitor C_i is employed to maintain current compensation signal CMP_i. As a result, when dimming signal DIM is activated, PWM generator 1012 is configured to provide control signal CTRL in accordance with current regulating loop, and when dimming signal DIM is deactivated, PWM generator 1012 is configured to provide control signal CTRL in accordance with voltage regulating loop.

Feedback output current Ibus_fb and a feedback bus voltage Vbus_ovp are employed to detect fault conditions at first rectified circuit 904 described foregoing. A comparator CMP1 is employed to detect an over current fault condition at first rectified circuit 904. Feedback output current Ibus_fb is coupled to an inverting terminal of comparator CMP1, and a reference level Vth_ocp is coupled to a non-inverting terminal of comparator CMP1. When a short or an over current condition happens at first rectified circuit 904, comparator CMP1 provides an activated output and triggers a fault signal FAULT (e.g., FAULT='1'). A comparator CMP2 is employed to detect an over voltage fault condition at first rectified circuit 904. In one embodiment, bus voltage V_bus is divided by a resistor divider, and feedback bus voltage Vbus_ovp is provided accordingly. Feedback bus voltage Vbus_ovp is coupled to a non-inverting terminal of comparator CMP2, and a reference level Vth_ovp is coupled to an inverting terminal of comparator CMP2. When an over voltage condition happens at first rectified circuit 904, comparator CMP2 provides an activated output and triggers fault signal FAULT (e.g., FAULT='1').

An OR gate OR1 is configured to provide fault signal FAULT in accordance with output of comparator CMP1 and output of comparator CMP2. It is noted that any fault detected by comparator CMP1 or comparator CMP2 will trigger fault signal FAULT.

Driving circuit 1013 is configured to provide driving signals for primary side switch S1 and primary side switch S2 in accordance with fault signal FAULT and control signal CTRL. When fault signal FAULT indicates fault condition at first rectified circuit 904, driving signals are disabled to turn OFF primary side switch S1 and primary side switch S2. When fault signal FAULT is deactivated, driving circuit 1013 provides driving signals in accordance with control signal CTRL.

Continuing with FIG. 9 and FIG. 10, feedback LED current ILED_fb, feedback output current ISSD_fb and a feedback output voltage VLED_fb are employed to detect fault conditions at second rectified circuit 905. A comparator CMP3 is employed to detect an over current fault condition. Feedback LED current signal ILED_fb is coupled to a non-inverting input terminal of comparator CMP3, and a reference level Vth_OCPL is coupled to an inverting terminal of comparator CMP3. When an over current condition happens at the LED string, comparator CMP3 provides an activated output and triggers a fault signal FAULT_LED (e.g., FAULT_LED='1'). A comparator CMP4 is employed to detect an over current fault condition at output of second rectified circuit 905. Feedback output current ISSD_fb is coupled to an inverting terminal of comparator CMP4, and a reference level Vth_ssd is coupled to a non-inverting terminal of comparator CMP4. When an over current condition happens at output of second rectified circuit 905, comparator CMP4 provides an activated output and triggers fault signal FAULT_LED (e.g., FAULT_LED='1'). A comparator CMP5 is employed to detect an over voltage fault condition at output of second rectified circuit 905. In one embodiment, output voltage V_LED is divided by a resistor divider and then feedback output voltage VLED_fb is provided accordingly. Feedback output voltage VLED_fb is coupled to a non-inverting terminal of comparator CMP5, and a reference level Vth_ovpl is coupled to an inverting terminal of comparator CMP5. When an over voltage condition happens at output of second rectified circuit 905, comparator CMP5 provides an activated output and triggers fault signal FAULT_LED (e.g., FAULT_LED='1').

An OR gate OR2 is configured to provide fault signal FAULT_LED in accordance with output of comparator CMP3, output of comparator CMP4 and output of comparator CMP5. It is noted that any fault detected by comparator CMP3, comparator CMP4 or comparator CMP5 will trigger fault signal FAULT_LED.

Dimming circuit 1014 is configured to provide dimming signal DIM in accordance with a brightness control signal DBRT and fault signal FALUT_LED. When fault signal FAULT_LED is activated, e.g., logic HIGH, dimming signal DIM is configured to be deactivated.

One of ordinary skill in the art will appreciate that brightness control signal DBRT may be a DC signal or a pulse-width modulation (PWM) signal without detracting from the merits of the present invention. For example, 1V or 70% duty cycle.

Protecting switch driver 1015 comprises two inputs and one output. One input is coupled to fault signal FAULT_LED indicating fault conditions at second rectified circuit 905, and the other input is coupled to dimming signal DIM. Protecting switch driver 1015 outputs driving signal P_drive in accordance with fault signal FAULT_LED and dimming signal DIM. Driving signal P_drive is coupled to a control terminal of protection switch S3. When driving signal P_drive is activated, protection switch S3 is configured to be turned ON and when driving signal P_drive is deactivated, protection switch S3 is configured to be turned OFF. In one embodiment, when fault signal FAULT_LED is activated or dimming signal DIM is in deactivated, driving signal P_drive is configured to be deactivated and protection switch S3 is configured to be turned OFF.

Dimming switch driver 1016 comprises two inputs and one output. One input is coupled to fault signal FAULT_LED indicating fault conditions at second rectified circuit 905, and the other input is coupled to dimming signal DIM. Dimming switch driver 1016 outputs driving signal D_drive in accordance with fault signal FAULT_LED and dimming signal DIM. Driving signal D_drive is coupled to a control terminal of dimming switch S4. When driving signal D_drive is activated, dimming switch S4 is turned ON and when driving signal P_drive is deactivated, dimming switch S4 is turned OFF. In one embodiment, when fault signal FAULT_LED is activated or dimming signal DIM is in deactivated, Driving signal D_drive is configured to be deactivated and dimming switch S4 is configured to be turned OFF.

It is noted that the logics of "HIGH" or "LOW" for the logic signals may be in alternative levels since different logic levels may lead to a same result. For example, when over voltage condition happens at first rectified circuit 904, switch S1 and switch S2 are configured to be turned OFF no matter output of comparator CMP2 is logic HIGH or logic LOW.

It should be noted that controller 906 may be integrated on one chip or be integrated with other circuits.

Figure 11:
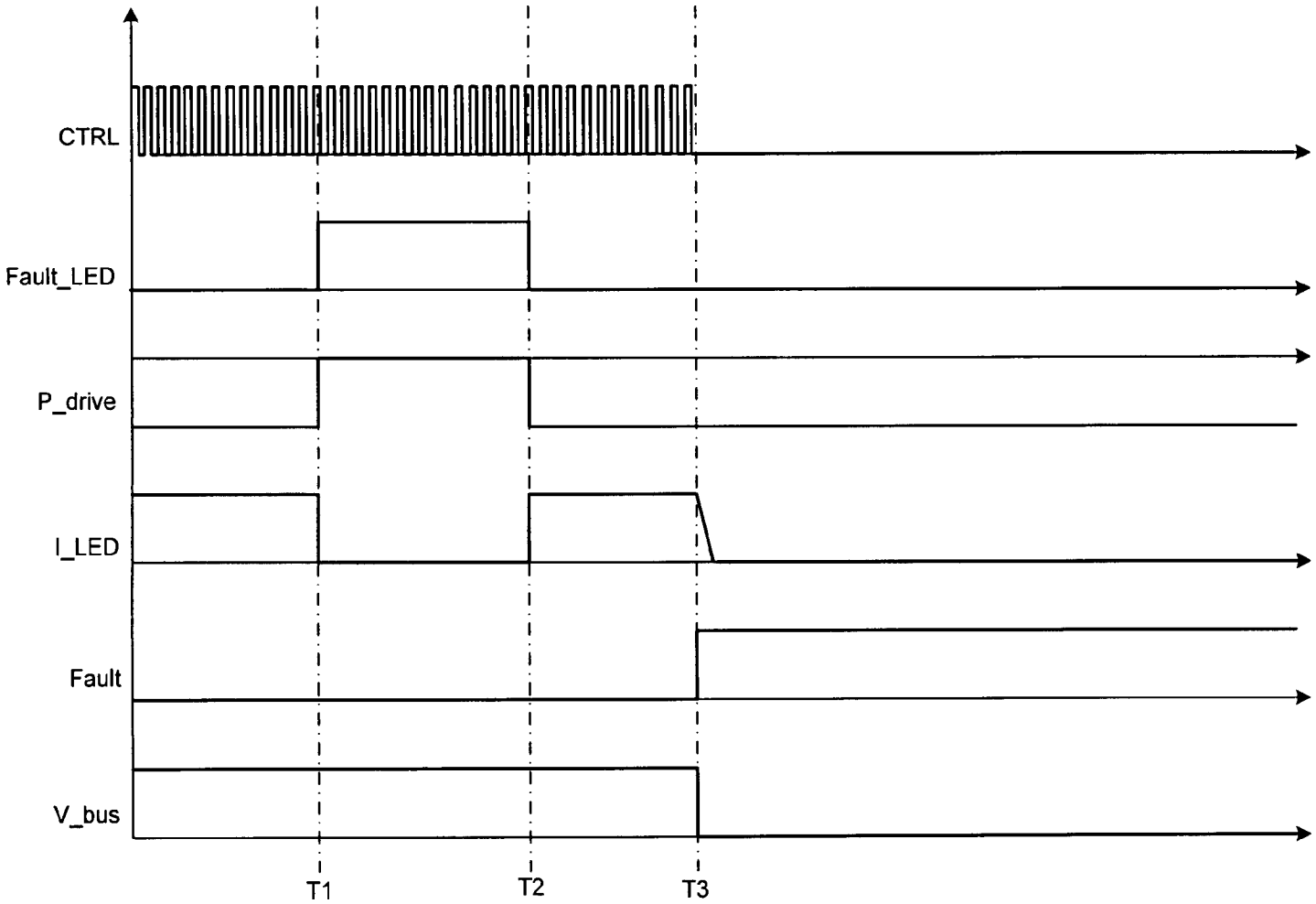
FIG. 11 shows waveforms of the circuit of FIG. 10 in accordance with one embodiment of the present invention.

FIG. 11 shows waveforms of the circuit of FIG. 10 in accordance with one embodiment of the present invention. A first waveform shows control signal CTRL. HIGH logic control signal CTRL indicates that switch S1 is turned ON, and LOW logic control signal CTRL indicates that switch S1 is turned OFF. A second waveform shows fault signal FAULT_LED. High logic fault signal FAULT_LED means that fault condition happens at second rectified circuit 905. A third waveform shows driving signal P_drive. When driving signal P_drive is logic HIGH, protection switch S3 is configured to be turn ON. A fourth waveform shows LED current I_LED. When LED string is forward biased, LED current I_LED is shown as logic HIGH. Otherwise, LED current I_LED is shown as logic LOW. A fifth waveform shows fault signal FAULT. HIGH logic fault signal FAULT means that fault condition happens at first rectified circuit 904. A sixth waveform shows bus voltage V_bus. It is noted that only logic level is shown in FIG. 11 for clarity and simplicity.

Before time T1, both fault signal FAULT_LED and fault signal FAULT are logic LOW, i.e., deactivated, and the whole LED backlight driver system is operating normally.

At time T1, fault occurs at second rectified circuit 905, and fault signal FAULT_LED is set HIGH, i.e., activated to indicating that fault condition happens. Driving signal P_drive for protection switch S3 is set deactivated. And then protection switch S3 is turned OFF, LED string is cut off from output of second rectified circuit 905. As a result, no current flows through LED string and LED current I_LED becomes logic LOW. At the same time, no fault occurs at first rectified circuit 904, control signal CTRL continues as time before T1 and primary circuit 903 keeps normal operation. As a result, first rectified circuit 904 keeps normal operation and outputs normal bus voltage V_bus.

At time T2, second rectified circuit 905 heals back to normal operation, and fault signal FAULT_LED becomes deactivated. Driving signal P_drive for protection switch S3 is set activated. And then protection switch S3 is turned ON again, LED string is coupled to output of second rectified circuit 905. As a result, current flows through LED string and LED current I_LED heals back to normal.

At time T3, fault occurs at first rectified circuit 904, and fault signal FAULT is set HIGH, i.e., activated to indicating that fault condition happens. Control signal CTRL becomes invalid, switch S1 and switch S2 are turned OFF. As a result, bus voltage V_bus and LED current I_LED become LOW. The whole LED backlight driver system is configured to be turned OFF.

Figure 12:
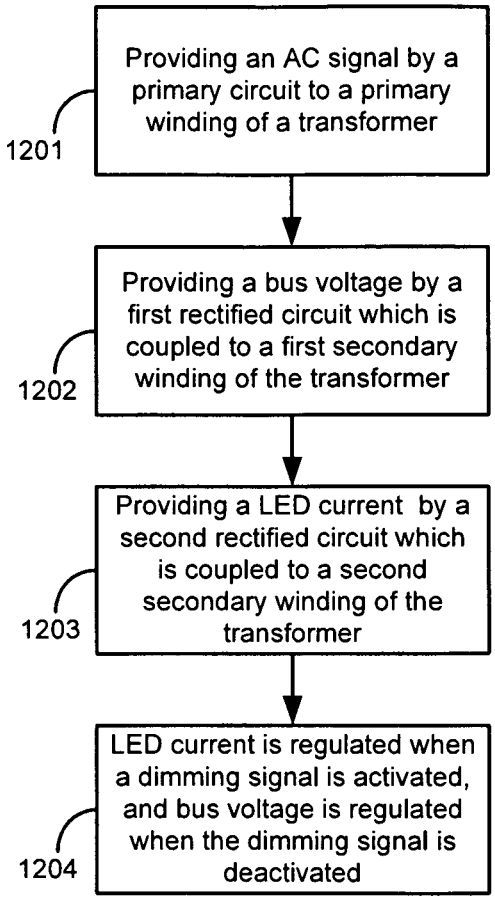
FIG. 12 is a block diagram illustrating a method for driving a LED backlight circuit in accordance with one embodiment of the present invention.

FIG. 12 is a block diagram illustrating a method for driving a LED backlight circuit in accordance with one embodiment of the present invention.

At stage 1201, providing an AC signal to a primary winding of a transformer, the AC signal is provide by a primary circuit, and the primary circuit is configured to receive a first input signal. In one embodiment, the first input signal is received from an output of a power factor correction circuit. At stage 1202, providing a bus voltage V_bus by a first rectified circuit, and the first rectified circuit is coupled to a first secondary winding of the transformer. In one embodiment, the method further comprises a DC/DC converter, whose input is coupled to receive bus voltage V_bus. At stage 1203, providing a LED current I_LED by a second rectified circuit, wherein the second rectified circuit is coupled to a second secondary winding of the transformer. At stage 1204, providing a dimming signal DIM, wherein LED current I_LED is regulated when dimming signal DIM is activated, and wherein bus voltage V_bus is regulated when dimming signal DIM is deactivated.

In one embodiment, LED current I_LED is regulated to a current reference IREF when dimming signal DIM is activated and bus voltage V_bus is regulated to a voltage reference VREF. Voltage reference VREF may be lower than bus voltage V_bus when dimming signal DIM is activated.

In one embodiment, a current compensation signal CMP_i is provided by comparing a feedback current signal ILED_fb with current reference IREF. Feedback LED current signal ILED_fb indicates a value of LED current I_LED. A voltage compensation signal CMP_v is provided by comparing a feedback voltage signal Vbus_fb with voltage reference VREF. Feedback voltage signal Vbus_fb indicates a value of bus voltage V_bus. A driving signal is generated in accordance with current compensation signal CMP_i when dimming signal DIM is activated and the driving signal is generated in accordance with voltage compensation signal CMP_v when dimming signal DIM is deactivated. Voltage compensation signal CMP_v may keep its value when dimming signal DIM is activated, and current compensation signal CMP_i may keep its value when dimming signal DIM is deactivated.

In one embodiment, when fault condition occurs at second rectified circuit, diming signal DIM is set deactivated. Meanwhile, primary circuit keeps its normal operation to provide bus voltage V_bus.

In one embodiment, when fault condition occurs at first rectified circuit, primary side switch is turned OFF and no power is provided to both first and second rectified circuit.

The above description and discussion about specific embodiments of the present technology is for purposes of illustration. However, one with ordinary skill in the relevant art should know that the invention is not limited by the specific examples disclosed herein. Variations and modifications can be made on the apparatus, methods and technical design described above. Accordingly, the invention should be viewed as limited solely by the scope and spirit of the appended claims.

We claim:

1. A light-emitting diode (LED) driver system, comprising:

an isolated converter, having a primary side and a secondary side, wherein the primary side having a primary side switch, and wherein the secondary side having a first output configured to provide an LED current to supply an LED string, and having a second output configured to provide a bus voltage; and wherein the isolated converter is configured to regulate the LED current only when a dimming signal is activated, and the isolated converter is configured to regulate the bus voltage only when the dimming signal is deactivated.

2. The LED driver system of claim 1, further comprising:

a controller, having a first input, a second input, a first output and a second output, wherein the first input is coupled to the first output of the isolated converter, wherein the second input is coupled to the second output of the isolated converter, wherein the first output of the controller is coupled to a control terminal of the primary side switch, and wherein the second output of the controller is configured to provide the dimming signal; and wherein the first output of the controller is responsive to the LED current only when the dimming signal is activated, and the first output of the controller is responsive to the bus voltage only when the dimming signal is deactivated.

3. The LED driver system of claim 1, further comprising:

a current regulating loop, having an input and an output, wherein the input is configured to receive a feedback current signal of the LED current, and wherein the output is configured to provide a current compensation signal by comparing the feedback current signal with a current reference; and a voltage regulating loop, having an input and an output, wherein the input is configured to receive a feedback voltage signal of the bus voltage, and wherein the output is configured to provide a voltage compensation signal by comparing the feedback voltage signal with a voltage reference; and wherein the primary side switch is regulated responsive to the current compensation signal only when the dimming signal is activated, and the primary side switch is regulated responsive to the voltage compensation signal only when the dimming signal is deactivated.

4. The LED driver system of claim 3, further comprising a switch, having a control terminal, a first terminal, and a second terminal, wherein:

the control terminal is configured to receive the dimming signal;

the first terminal is coupled to the output of the current regulating loop when the dimming signal is activated, and the first terminal is coupled to the output of the voltage regulating loop when the dimming signal is deactivated; and the second terminal is coupled to a control terminal of the primary side switch.

5. The LED driver system of claim 3, further comprising:

a first diode, having an anode and a cathode, wherein the anode is coupled to the output of the current regulating loop;

a second diode, having an anode and a cathode, wherein the anode is coupled to the output of the voltage regulating loop; and a PWM generator, having an input and an output, wherein the input is coupled to the cathode of the first diode and the cathode of the second diode, and wherein the output is coupled to a control terminal of the primary side switch.

6. The LED driver system of claim 3, wherein the current regulating loop comprises:

an amplifier, comprising a first input, a second input and an output, wherein the first input is coupled to receive the feedback current signal of the LED current, the second input is coupled to receive the current reference, and the output is coupled to the output of the current regulating loop;

a first switch, having a first terminal coupled to receive a voltage, a second terminal coupled to the first input of the amplifier and a control terminal configured to receive the dimming signal;

a second switch, having a first terminal coupled to the output of the amplifier, a second terminal and a control terminal configured to receive the dimming signal; and a capacitor, having a terminal coupled to the second terminal of the second switch.

7. The LED driver system of claim 3, wherein the voltage regulating loop comprises:

an amplifier, comprising a first input, a second input and an output, wherein the first input is coupled to receive the feedback voltage signal of the bus voltage, the second input is coupled to receive the voltage reference and the output of the amplifier is coupled to the output of the voltage regulating loop;

a first switch, having a first terminal coupled to receive a voltage, a second terminal coupled to the first input of the amplifier and a control terminal configured to receive the dimming signal;

a second switch, having a first terminal coupled to the output of the amplifier, a second terminal and a control terminal configured to receive the dimming signal; and a capacitor, having a terminal coupled to the second terminal of the second switch.

8. The LED driver system of claim 1, wherein the isolated converter further comprises:

an isolated transformer, having a primary winding at the primary side, and a first secondary winding and a second secondary winding at the secondary side, wherein the primary winding is coupled to the primary side switch;

a first rectified circuit coupled to the first secondary winding, wherein the first rectified circuit is configured to provide the bus voltage; and a second rectified circuit coupled to the second secondary winding, wherein the second rectified circuit is configured to provide the LED current.

9. The LED driver system of claim 8, further comprising a protection switch having a first terminal, a second terminal and a control terminal, wherein the first terminal is coupled to the second rectified circuit, wherein the second terminal is coupled to the LED string, wherein the control terminal is coupled to receive a protection signal indicating a fault condition at the second rectified circuit, and wherein the protection switch is configured to be turned OFF when a fault condition occurs at the second rectified circuit.

10. The LED driver system of claim 1, further comprising a dimming switch coupled to the LED string in series, wherein the dimming switch has a control terminal, and wherein the control terminal is configured to receive the dimming signal.

11. A method for driving an LED backlight circuit, comprising:

providing an AC signal to a primary winding of a transformer, wherein the AC signal is provide by a primary circuit, and wherein the primary circuit is configured to receive a first input signal;

providing a bus voltage by a first rectified circuit, wherein the first rectified circuit is coupled to a first secondary winding of the transformer;

providing an LED current by a second rectified circuit, wherein the second rectified circuit is coupled to a second secondary winding of the transformer; and providing a dimming signal, wherein the LED current is regulated only when the dimming signal is activated, and wherein the bus voltage is regulated only when the dimming signal is deactivated.

12. The method of claim 11, further comprising supplying a DC/DC converter by the bus voltage.

13. The method of claim 11, further comprising:

regulating the LED current to a current reference when the dimming signal is activated; and regulating the bus voltage to a voltage reference when the dimming signal is deactivated.

14. The method of claim 13, wherein the voltage reference is lower than the bus voltage when the dimming signal is activated.

15. The method of claim 11, further comprising:

providing a current compensation signal responsive to the LED current;

providing a voltage compensation signal responsive to the bus voltage; and providing a driving signal, coupled to the primary circuit; and wherein the driving signal is generated responsive to the current compensation signal only when the dimming signal is activated; and the driving signal is generated responsive to the voltage compensation signal only when the dimming signal is deactivated.

16. The method of claim 15, wherein the voltage compensation signal keeps its value when the dimming signal is activated, and wherein the current compensation signal keeps its value when the dimming signal is deactivated.

17. The method of claim 11, wherein the dimming signal is set deactivated when a fault condition occurs at the second rectified circuit, and wherein the primary circuit is turned OFF when a fault condition occurs at the first rectified circuit.

18. The method of claim 11, wherein the first input signal is received from an output of a power factor correction circuit.

* * * * *